US006732611B2

(12) United States Patent
Miguel

(10) Patent No.: US 6,732,611 B2
(45) Date of Patent: May 11, 2004

(54) ARTICULATED CORKSCREW

(76) Inventor: Francisco Jose Traspuesto Miguel, Calle Caramuxo 37-39-41, 36213 Vigo, Pontevedra (ES)

( * ) Notice: Subject to any disclaimer, the term of this patent is extended or adjusted under 35 U.S.C. 154(b) by 0 days.

(21) Appl. No.: 10/066,412

(22) Filed: Jan. 31, 2002

(65) Prior Publication Data

US 2003/0140733 A1 Jul. 31, 2003

(51) Int. Cl.[7] ..... B67B 7/04

(52) U.S. Cl. ..... 81/3.29; 81/3.47; 81/3.36; 81/3.45

(58) Field of Search ..... 81/3.29, 3.36, 81/3.45, 3.55, 3.47, 3.56, 3.48, 3.35

(56) References Cited

U.S. PATENT DOCUMENTS

| | | | | |
|---|---|---|---|---|
| 522,672 A | * | 7/1894 | Puddefoot | 81/3.35 |
| 4,584,911 A | | 4/1986 | Cellini | |
| 5,992,269 A | * | 11/1999 | Puig et al. | 81/3.47 |
| 6,073,519 A | | 6/2000 | Presa Eguren | |
| 6,101,900 A | | 8/2000 | Traspuesto Miguel | |
| 6,116,116 A | | 9/2000 | Brucart Puig et al. | |
| 6,327,936 B1 | | 12/2001 | Eguren | |
| 6,397,704 B1 | | 6/2002 | Olaneta | |
| 6,401,569 B2 | | 6/2002 | Usbeck | |

FOREIGN PATENT DOCUMENTS

| | | |
|---|---|---|
| EP | 0 955 264 A1 | 5/1999 |
| ES | 1 020 637 | 7/1992 |
| ES | 1 035 671 | 5/1997 |

* cited by examiner

*Primary Examiner*—D. S. Meislin
(74) *Attorney, Agent, or Firm*—Brinks Hofer Gilson & Lione

(57) ABSTRACT

A corkscrew incorporating a support arm with two articulated sections capable of acting independently and sequentially by resting on a bottle's mouth. The sections are connected to each other through a joint that has a spring that causes one of the sections to seek out the side or mouth of the bottle where it is to be positioned, without the need for a corkscrew user to deliberately perform this operation. The spring is set at the level of the articulated joint between the arm and body or handle, the ends of which form aligned and opposing pivots that emerge laterally from the body, where the arm incorporates a circumferential arrangement of notches over which the pivots must move during the swinging movement of the arm with respect to the body. This prevents undesired movement between the arm and the body, no matter what relative position is chosen for them.

7 Claims, 4 Drawing Sheets

A - B

ARTICULATED CORKSCREW

PURPOSE OF THE INVENTION

The invention refers to an articulated corkscrew, of the type incorporating a handle to which a spiral worm is joined for insertion into and removal of the cork; a support arm intended to rest on the mouth of the bottle is joined to this handle in an articulated manner, constituting the fulcrum on which the handle tilts and allowing the latter to act as a second-class lever.

More specifically, the invention concerns a corkscrew in whose support arm two articulated sections are established, provided with respective stepped areas which rest on the bottle's mouth and act sequentially, and focuses on a special configuration in said arm that substantially improves its functionality, and as a result, the functionality of the corkscrew as a whole.

BACKGROUND OF THE INVENTION

Within the wide range of corkscrews on the market, one of the usual solutions consists of having a spiral worm based on a rod with a sharp, pointed free end, intended to be inserted axially into the cork of the bottle, a spiral worm which is joined at its upper end to a handle in an articulated manner; on the one hand, this handle facilitates the insertion of the spiral worm into the cork, and on the other hand, it allows later axial traction on the worm in order to extract the cork, to which effect the aforementioned handle incorporates an articulated arm on one of its ends, which rests on the bottle's mouth, and which by acting as a fulcrum makes the corkscrew a second-class lever.

This arm, which is conventionally a single piece, is too long when the act of extracting the cork is begun, and too short when said extraction reaches its end, all according to the degree of extraction of the cork with respect to the bottle, and thus there are different known solutions to increase the effectiveness of the support arm as extraction of the cork takes place.

In this sense, European Patent EP 0955264 A1 should be mentioned as an example, in which a corkscrew is described whose support arm is provided with lateral grooves or channels, in the shape of an "L," in which a pin forming the swing axis for the handle takes part, so that according to the position said pin occupies in the lateral grooves, an effective length is achieved for the arm as a whole. This solution, while efficient, involves a noticeably complicated maneuver which is relatively difficult to perform.

Another solution, reflected in Spanish Utility Model U 9602975, consists of setting a second arm on the central area of the support arm; this second arm is considerably shorter and swings, and as a swinging arm is capable of being projected towards the inside of the arm, to constitute a first support point, when an external appendage that goes through the main arm is acted upon. The basic problem with this solution is the high risk that the user may get his or her fingers caught by this intermediate swinging arm.

Another solution is the one reflected in Spanish Utility Model U 9200910, where two physically-independent axial sections are established in the support arm, joined to each other in an articulated manner and provided with respective rests, so that during the initial phase of extracting the cork the first section of the arm is used, with its respective rest acting on the bottle's mouth, while in the final phase of extracting the cork the second section of the arm becomes operational, with its rest being placed on the bottle's mouth, thus increasing the effectiveness of the arm as a whole, so that the latter satisfactorily performs its function.

However, this simple articulated joint between the arm's two sections makes a deliberate manual maneuver necessary to set the second section of the arm onto the bottle's rim or mouth, which is awkward at the very least.

On the other hand, during the normal use of the corkscrew and after a relatively short period of time, the axis through which the arm is joined to the handle or body in an articulated manner suffers wear and tear, causing a slackness that prevents the body and arm from staying aligned, so that said arm swings toward a vertical position through mere gravity, hindering the action of placing it on the cork and hurting the hand that holds the bottle.

DESCRIPTION OF THE INVENTION

The characteristics of the corkscrew that is proposed, which is of the last type of those mentioned above, in other words, of the type incorporating a support arm with two articulated sections capable of acting independently and sequentially by resting on the bottle's mouth, focus on the fact that the aforementioned sections are related to each other, apart from through the aforementioned swing axis, through a spring that causes the second rest, the one corresponding to the end section, to seek out on its own the bottle's side or mouth where it is to be situated, with no need for the person who is opening the bottle to deliberately perform this maneuver.

In accordance with another of the characteristics of the invention, a spring is set at the level of the articulated joint between the arm and body or handle, whose ends form aligned and opposing pivots that emerge laterally from the body and that act on the inner face of the arm's lateral branches, where the arm incorporates a circumferential arrangement of notches that must be "jumped" by the aforementioned pivots during the swinging movement of the arm with respect to the body, which prevents accidental or undesired movement between these two components, no matter what position is chosen for them.

DESCRIPTION OF THE DRAWINGS

To complement this description and for the purpose of allowing for better understanding of the characteristics of the invention, in accordance with the example of its preferred embodiment, a set of drawings of an illustrative and non-restrictive nature, in which the following items are represented, is attached as an integral part of this description.

PREFERRED EMBODIMENT OF THE INVENTION

Figure 1:
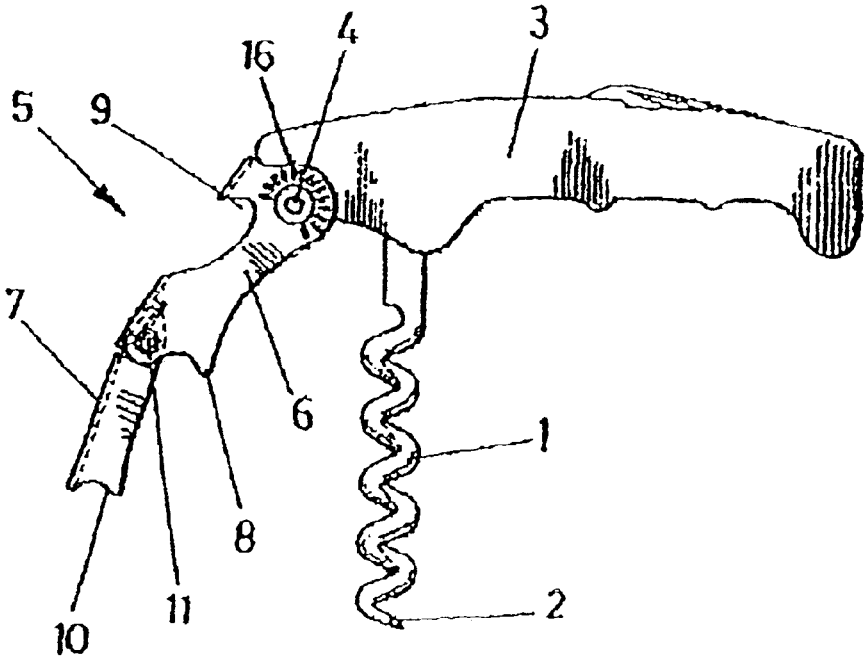
FIG. 1 is a side elevation view of an articulated corkscrew according to the invention.
Figure 2:
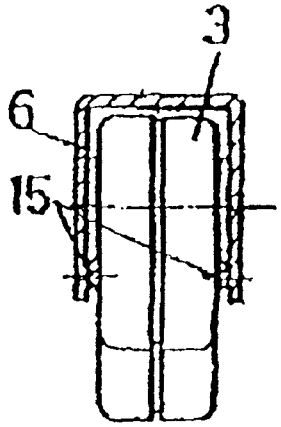
FIG. 2 is a top view of a section of a support arm and handle of the articulated corkscrew.
Figure 3:
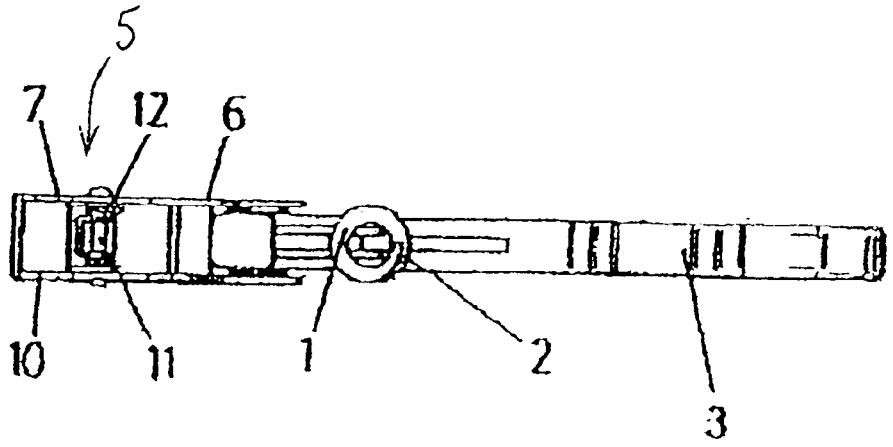
FIG. 3 is a bottom plan view of an articulated corkscrew.
Figure 4:
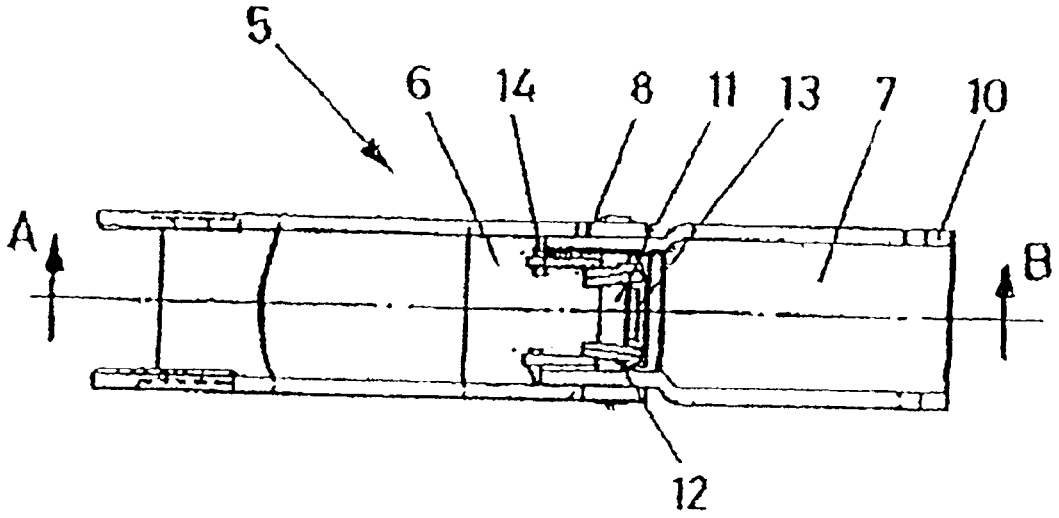
FIG. 4 is an enlarged detail of a section of a support arm.

In looking at the figures described, and especially FIGS. 1 and 3, it can be seen how the proposed corkscrew is of the type incorporating a spiral worm (1), ending in a sharp point (2), which is intended to be axially inserted into the cork; this spiral worm (1) is joined at its other end, in an articulated manner, to a handle (3), which, acting as a second-class lever, in turn receives a support arm (5) in an articulated manner, at one of its ends, specifically through axis (4). The support arm (5) is made up of two sections (6) and (7), one of which is the nearer section (6) with its corresponding rest (8), intended to act on the bottle's rim or mouth, and which could, as is conventional, have an indentation (9) to act as a bottle opener; and an end section (7), equipped with a second rest (10) on its free end, which is functionally equivalent to rest (8) and intended to act after it, once the first phase of the cork-extraction process using the spiral worm (1) has taken place.

Figure 5:
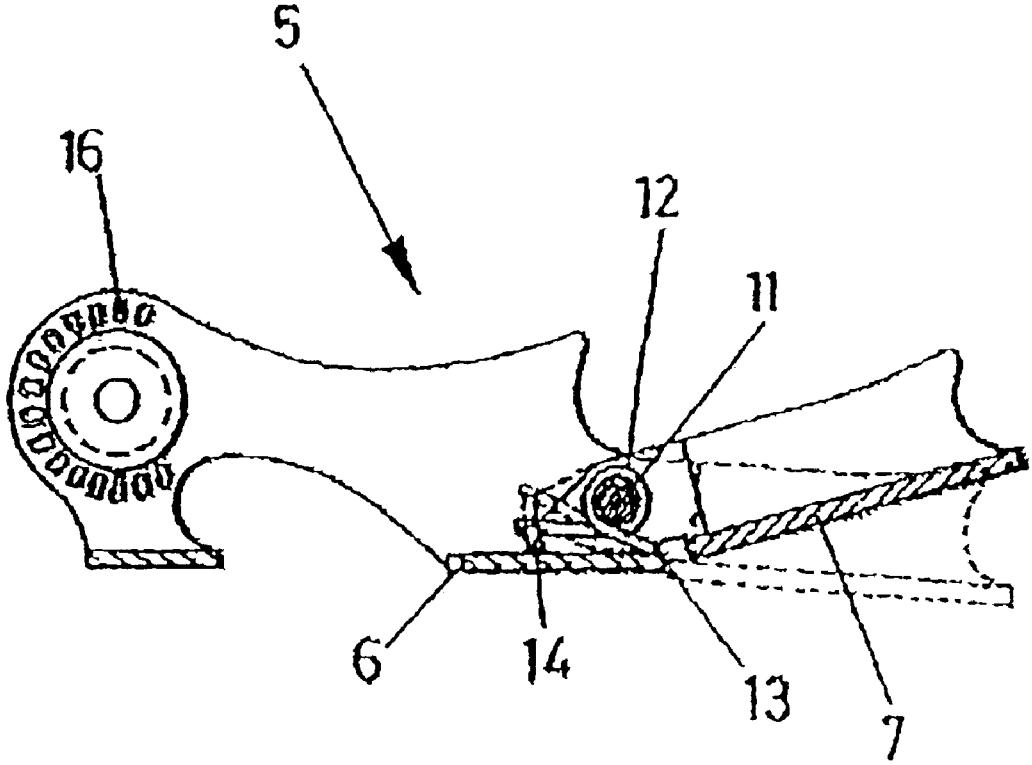
FIG. 5 is a side elevation detail of a cross-section of the support arm of FIG. 4, along section line A—B.

Starting with this basic, conventional structure, the improvements of the invention consist of the fact that on the axis (11) of the articulated joint between sections (6) and (7), a spring (12) is set in which two symmetrical parts are defined, which taken together form a type of "U," so that through its middle branch (13) said spring rests on the first section (6) of the arm (5), as can especially be seen in FIG. 5, while through its free ends or lateral branches, it rests on inward-bending extensions (14) of the second section (7), so that said spring (12) tends towards an extreme, stable position between sections (7) and (6) of the support arm, which causes the end section (7) to seek out on its own the side of the bottle where it is to be situated, as previously stated, with no need for the person using the corkscrew to manually guide it, as occurs in Utility Model 9200910, previously referenced.

Figure 6:
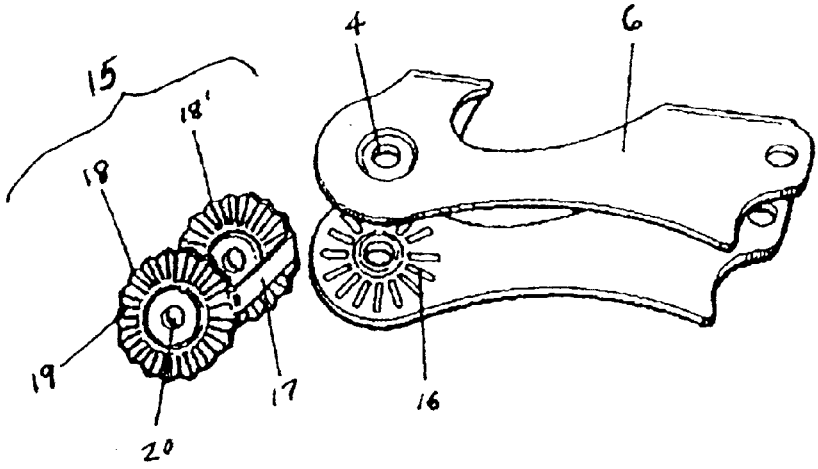
FIG. 6 is an enlarged detached detail of a section of a spring and support arm.
Figure 7:
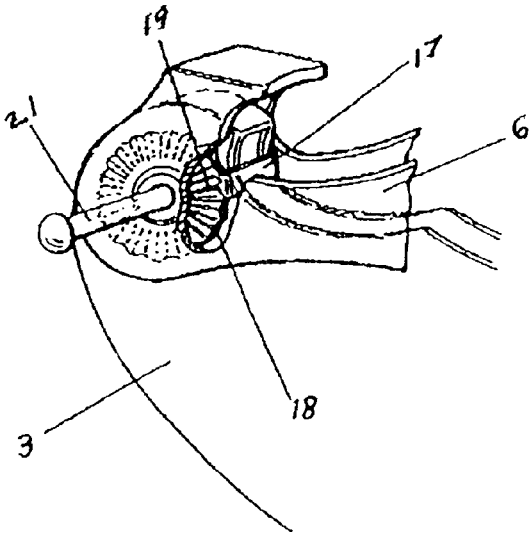
FIG. 7 is a a side cross-sectional detail of a section of a support arm, spring, and handle.
Figure 8:
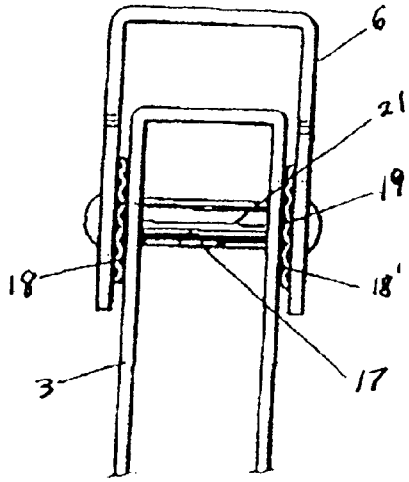
FIG. 8 is an enlarged back view of a section of a support arm, spring, and handle.

Turning to FIGS. 6–8, they show a transverse spring (15) that is preferably used in the corkscrew according to the invention. The spring (15) includes a central branch (17), lateral branches (18, 18'); pivots (19, 19'), set on the lateral branches (18, 18'); and a hole (20), through which a pin (21) is inserted along swing axis (4) to secure the spring within the first section (6) of the arm (5) of the corkscrew.

As a complement to the structure described, the a transverse spring (15) is set on the body or handle (3) of the corkscrew, in correspondence with the swing axis (4) for the nearer section (6) of arm (5). The lateral branches 18, 18' of this spring (15) emerge substantially from said handle (3) to act on the inner face of arm (6), where a line of radial notches (16) surrounds the axis (4) in an arrangement concentric to the latter, forming internal peaks, thus making up a toothed surface over which the pivots (19, 19') formed by the spring 15 must move; in other words, the pivots (19, 19') must "jump" the projecting parts of the notches (16) as the arm (6) swings with respect to the handle (3), which ensures that these components will remain stable with respect to each other, in any relative position chosen for them, such as, for example, a position of transverse alignment during the maneuver of inserting the spiral worm (1) into the cork, a position that remains stable over time as it is not affected by possible wear and tear on the axis (4). Therefore, even if there is wear and tear on the pivots (19, 19'), the elastic nature of the spring that forms them would make them gradually recover to maintain a situation of operability with respect to the notches (16).

What is claimed is:

1. An articulated corkscrew comprising:

a spiral worm to be axially inserted into a cork, joined in an articulated manner to a handle, which is joined in an articulated manner to a support arm that rests on a rim of a bottle, forming a second-class lever, wherein the support arm comprises a first support arm section and a second support arm section joined to each other in an articulated manner, one as an extension of the other; and a spring, disposed at a swing axis between the first and second support arm sections, which tends to maintain the first and second support arm sections in an extreme, stable position, wherein the second support arm section seeks out, on its own, the rim of the bottle.

2. The articulated corkscrew of claim 1, wherein the spring has two symmetrical halves, which taken together form a "U" shape, and which, through a central branch of the spring, rests internally on the first support arm section; wherein spiral sections are set on at least one of a plurality of lateral branches of the spring; wherein the spiral sections couple to the swing axis between the first and second support arm sections; and, wherein free ends of the lateral branches rest on inward-bending extensions of an end of the second support arm section.

3. The articulated corkscrew of claim 1, wherein the spring, through a central branch of the spring, rests internally on the first support arm section.

4. The articulated corkscrew of claim 1, the spring further comprising spiral sections set on at least one of a plurality of lateral branches of the spring, wherein the spiral sections couple to the swing axis between the first and second support arm sections.

5. The articulated corkscrew of claim 1, the support arm further comprising a plurality of notches.

6. The articulated corkscrew of claim 1, wherein the pivots emerge substantially to the outside of the handle and the notches are set on an inner face of the support arm.

7. The articulated corkscrew of claim 1, wherein the notches form a circumferential alignment concentric to the swing axis.

* * * * *